US009263017B2

(12) United States Patent
Lifshitz et al.

(10) Patent No.: US 9,263,017 B2
(45) Date of Patent: Feb. 16, 2016

(54) MODULAR ELECTRONIC MUSICAL KEYBOARD INSTRUMENT

(71) Applicants: Ronen Lifshitz, Rishon Lezion (IL); Sharon Lerner, Alfei Menashe (IL)

(72) Inventors: Ronen Lifshitz, Rishon Lezion (IL); Sharon Lerner, Alfei Menashe (IL)

( * ) Notice: Subject to any disclaimer, the term of this patent is extended or adjusted under 35 U.S.C. 154(b) by 0 days.

(21) Appl. No.: 14/435,225

(22) PCT Filed: Jan. 29, 2014

(86) PCT No.: PCT/IL2014/050100
§ 371 (c)(1),
(2) Date: Apr. 13, 2015

(87) PCT Pub. No.: WO2014/122642
PCT Pub. Date: Aug. 14, 2014

(65) Prior Publication Data

US 2015/0262565 A1 Sep. 17, 2015

(30) Foreign Application Priority Data

Feb. 10, 2013 (IL) ..... 224642

(51) Int. Cl.
*G10C 3/12* (2006.01)
*G10H 1/34* (2006.01)

(52) U.S. Cl.
CPC ..... *G10H 1/344* (2013.01); *G10H 2220/221* (2013.01)

(58) Field of Classification Search
CPC ..... G10H 2220/221; G10H 1/344
See application file for complete search history.

(56) References Cited

U.S. PATENT DOCUMENTS

| | | | | |
|---|---|---|---|---|
| 4,106,385 | A | 8/1978 | Roberts | |
| 4,428,267 | A | 1/1984 | Rosler | |
| 5,463,925 | A * | 11/1995 | Galocy | G10C 3/12 400/682 |
| 6,259,006 | B1 * | 7/2001 | Parienti | G10H 1/32 84/171 |
| 6,875,913 | B2 * | 4/2005 | Bubar | G10H 1/344 84/423 R |
| 7,465,868 | B2 * | 12/2008 | Lengeling | G10H 1/34 84/718 |
| 7,977,561 | B2 | 7/2011 | Folkesson | |
| 2005/0241467 | A1 * | 11/2005 | Lo | G10H 1/344 84/744 |
| 2009/0188378 | A1 * | 7/2009 | Folkesson | G10H 1/34 84/615 |
| 2015/0262565 | A1 * | 9/2015 | Lifshitz | G10H 1/344 84/433 |

FOREIGN PATENT DOCUMENTS

GB 1384783 2/1975

OTHER PUBLICATIONS

Search Report for PCT/IL2014/050100.

* cited by examiner

*Primary Examiner* — Robert W Horn
(74) *Attorney, Agent, or Firm* — Daniel J. Swirsky; AlphaPatent Associates Ltd.

(57) ABSTRACT

In one aspect, the present invention is directed to a modular electronic musical keyboard instrument, comprising: an array of separate keyboard segments (30, 32), each comprising a piano keyboard (20) in a range of one octave; a control system, for converting a keystroke of each key in the array of keyboard segments to a note sound in a level corresponding to the order of the key in the array of keyboard segments; octave order setting means (22), for determining to the control system the order of each keyboard segment in the array of keyboard segments; communication means of each of the keyboard segments with the control system; and connection means (12, 14) with another keyboard segment.

18 Claims, 6 Drawing Sheets

MODULAR ELECTRONIC MUSICAL KEYBOARD INSTRUMENT

CROSS-REFERENCE TO RELATED APPLICATIONS

This application is a U.S. National Phase Application under 35 U.S.C. 371 of International Application No. PCT/IL2014/050100, which has an international filing date of Jan. 29, 2014, and which claims the benefit of priority from Israel Patent Application No. 224,642, filed Feb. 10, 2013, the disclosures of which are incorporated herein by reference in their entirety.

TECHNICAL FIELD

The present invention relates to the field of electronic musical instruments. More particularly, the invention relates to a modular electronic music keyboard instrument.

BACKGROUND ART

A musical keyboard is a set of adjacent depressible levers or keys on a musical instrument, particularly the piano. Keyboards typically contain keys for playing the twelve notes of the Western musical scale. Depressing a key on the keyboard causes the instrument to produce sounds, either by mechanically striking a string or tine (piano, electric piano, clavichord); plucking a string (harpsichord); causing air to flow through a pipe (organ); or striking a bell (carillon).

On electric and electronic musical keyboard instruments, depressing a key connects a circuit (Hammond organ, digital piano, and synthesizer). Since the most commonly encountered keyboard instrument is the piano, the keyboard layout is often referred to as the "piano keyboard". (From Wikipedia, the free encyclopedia)

The octave range of a musical keyboard instrument is limited to the size designed by its manufacturer. As such, the octave range of the current musical keyboard instruments is a result of commercial considerations, which may not suit the special needs of an individual. For example, while an amateur user may need a synthesizer in a range of three octaves, a professional user may need a synthesizer of six octaves.

But beyond the musical preferences of octaves range, the type of music also dictates needs of the octave range, and furthermore, the portability of the synthesizer may be a point of consideration to some users.

As such, there is a long felt need for a modular electronic musical keyboard instrument with an octave range which may be adapted to the needs of an individual user.

It is an object of the present invention to provide a modular synthesizer that can be adapted to the needs of a user as per the octave range, dimensions and weight.

Other objects and advantages of the invention will become apparent as the description proceeds.

SUMMARY OF THE INVENTION

In one aspect, the present invention is directed to a modular electronic musical keyboard instrument, comprising:

- an array of separate keyboard segments (30, 32), each comprising a piano keyboard (20) in a range of one octave;
- a control system, for converting a keystroke of each key in the array of keyboard segments to a note sound in a level corresponding to the order of the key in the array of keyboard segments;

- octave order setting means (22), for determining to the control system the order of each keyboard segment in the array of keyboard segments;
- communication means of each of the keyboard segments with the control system; and
- connection means (12, 14) with another keyboard segment.

Preferably, the octave order setting means (22) comprise:

- an array of buttons, in which only one button can be set to on in a time point;
- wherein the order of each button in the array (22) of buttons (22) corresponds to the order to the segment thereof in the array of keyboard segments (30, 32).

The modular electronic musical keyboard instrument may further comprise a segment (26) of less than one octave, for connecting thereof to an extreme segment of the modular electronic musical keyboard instrument.

According to one embodiment of the invention, the control system is installed in one of the keyboard segments.

According to one embodiment of the invention, the control system comprises means for adjusting the octave level of the segments.

The modular electronic musical keyboard instrument may further comprise a percussion segment (28) attachable to each of the keyboard segments.

The communication means may be wired as well as wireless, such as USB communication, conductive wires, Bluetooth communication, RF communication, and so on.

The connection means may be carried out by a male-female connector, magnet, and so on.

Preferably, each first note of a keyboard segment is a C note, but the first note of an octave may also be another note.

According to one embodiment of the invention, each of the segments comprises a connector, for passing therethrough electric power to a subsequent keyboard segment thereof.

According to one embodiment of the invention, each of the segments comprises a connector, for passing therethrough a signal responsive to a keystroke to a subsequent keyboard segment thereof.

According to one embodiment of the invention, at least one of the segments comprises a touch screen, for being used as input means for setting the operation of the modular electronic musical keyboard instrument.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

Figure 1:
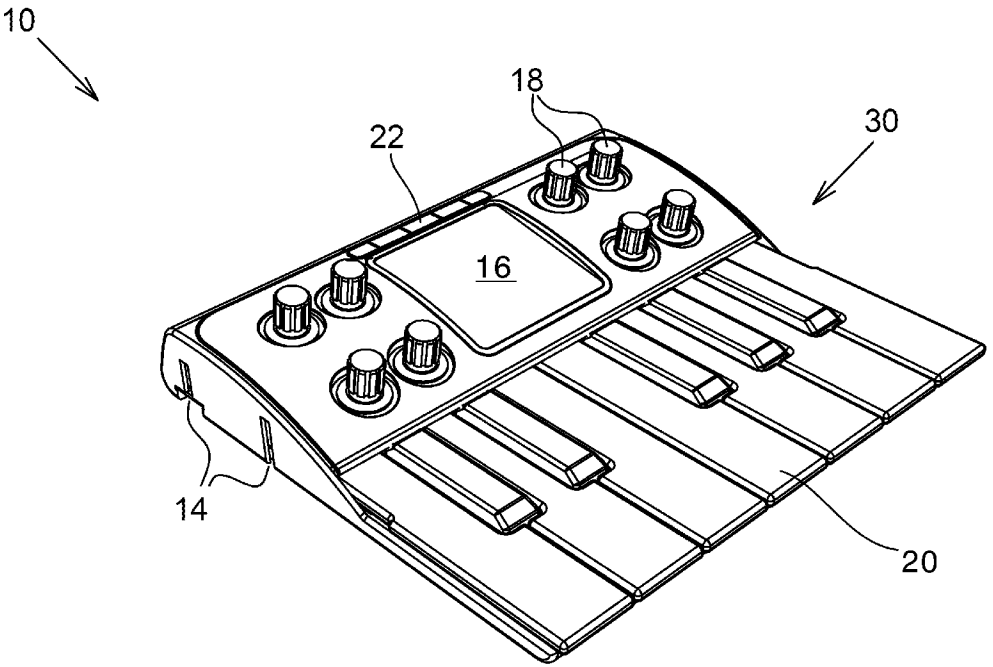
- FIG. 1 schematically illustrates a keyboard segment of a modular electronic musical keyboard instrument, according to one embodiment of the invention.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

The present invention refers to a modular electronic musical keyboard instrument built of an array of keyboard segments, each of the segments having a keyboard of one piano octave. The segments are connectable to each other in a subsequent order in a single row, thereby allowing adjusting the note range of the keyboard according to the needs of an individual.

From a technical point of view, each of the keyboards is a sensor. A simple type of sensor detects an on/off state ("switch") of a key. This kind of mechanism does not require a power supply. A more sophisticated key sensing mechanism may detect the velocity of a keystroke, acceleration or other analogical characteristics of a keystroke. For example, an influence of a velocity may be interpreted in loudness: the faster the player depresses the key, the louder the generated sound. These kinds of keys may require a power supply.

One of the keyboard segments may be used for hosting a control system, i.e., input interface for tuning the generated sound, amplifying the sound, electronics for distorting the sound, calibration, and so on.

Each side (left, right) of a keyboard segment is connectable to a subsequent keyboard segment.

A keyboard segment does not necessarily need to have twelve keys, but fewer. Such playing segments are directed to be connected to the left/right playing segments of the modular electronic musical keyboard instrument, for adding thereof less than a full octave keyboard.

Furthermore, a keyboard segment may also be designed for purposes other than as note keys, such as for playing percussion.

In order to define the octave level of a keyboard segment, each of the keyboard segments is provided with an array of buttons. Preferably, the buttons for defining the octave level are arranged in a line, such that the location of each button in the line defines the octave level thereof. In this way, the presentation and defining of the octave level of each of the keyboard segments is visualized, and therefore it is comprehensive.

The "major" keyboard segment is the segment in which is installed a control system. Preferably, a "common" octave such as C0 or C1 is assigned to this segment. In this way, the control buttons and knobs are disposed in a convenient place to be manipulated by a user.

A playing segment does not necessarily have to start in a C note (i.e., "CDEFGAB") but also start in another key, such as A (i.e., "ABCDEFG").

As per passing information between the keyboard segments and the control system, it can be carried out by wired or wireless means, such as USB, MIDI, Bluetooth, and so on.

The keys of a keyboard are actually sensors. A sensor may be merely an on/off switch, or a velocity key, i.e., a sensor that detects the velocity of the key, and allows the circuitry of the modular electronic musical keyboard instrument (in the control system) to adjust the volume of the played note accordingly.

The means for physically attaching one keyboard segment to the other can be mechanical (such as male-female connector), magnetic, and so on.

FIG. 1 schematically illustrates a keyboard segment of a modular electronic musical keyboard instrument, according to one embodiment of the invention.

The modular electronic musical keyboard instrument is marked herein by reference numeral 10. The keyboard segment, which is marked herein by reference numeral 30, is in a range of a single octave keyboard.

The case of the keyboard segment is also used as a control system, i.e., it comprises electronics for producing sound responsive to key strokes/release of keys 20, knobs 18 for tuning the operation of the modular electronic musical keyboard instrument, and so on. It should be noted that knobs are merely an example, and other control means may be used for this purpose, such as sliders.

The keyboard segment may comprise a built-in amplifier and speaker, or be adapted to use external facilities thereof. Reference numeral 16 denotes a screen for displaying information regarding the operation of the modular electronic musical keyboard instrument. According to one embodiment of the invention, the screen is touch-sensitive, and therefore may be used as an input means for controlling the operation of the modular electronic musical keyboard instrument, such as tuning the sound, adjusting the volume, and so on.

Reference numeral 14 denotes slots of female connectors, for connoting thereto other keyboard segments.

Figure 2:
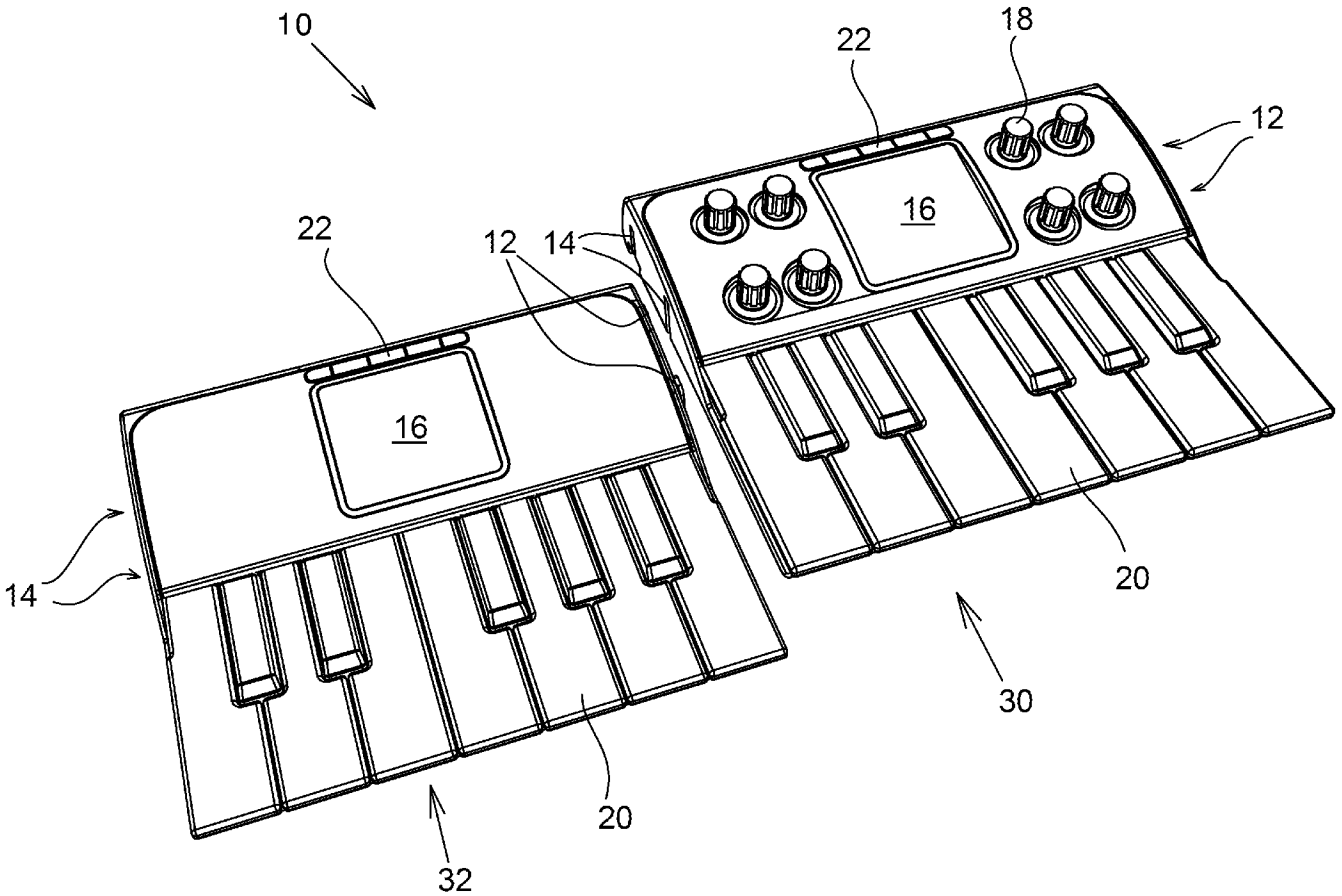
- FIG. 2 schematically illustrates two keyboard segments of a modular electronic musical keyboard instrument, according to one embodiment of the invention.

FIG. 2 schematically illustrates two keyboard segments of a modular electronic musical keyboard instrument, according to one embodiment of the invention.

Keyboard segment 30 is used also as a control system, while keyboard segment 32 is used merely as a keyboard.

Each keyboard segment is coupled with a male connector 12 and a female connector 14. This way the segments are connected each other.

As illustrated, keyboard segment 32 does not employ control knobs, as it is used merely as a keyboard.

Each of the keyboard segments uses an array of buttons 22 for determining the octave level of the playing segment, as described hereinafter, and illustrated in FIG. 3.

Figure 3:
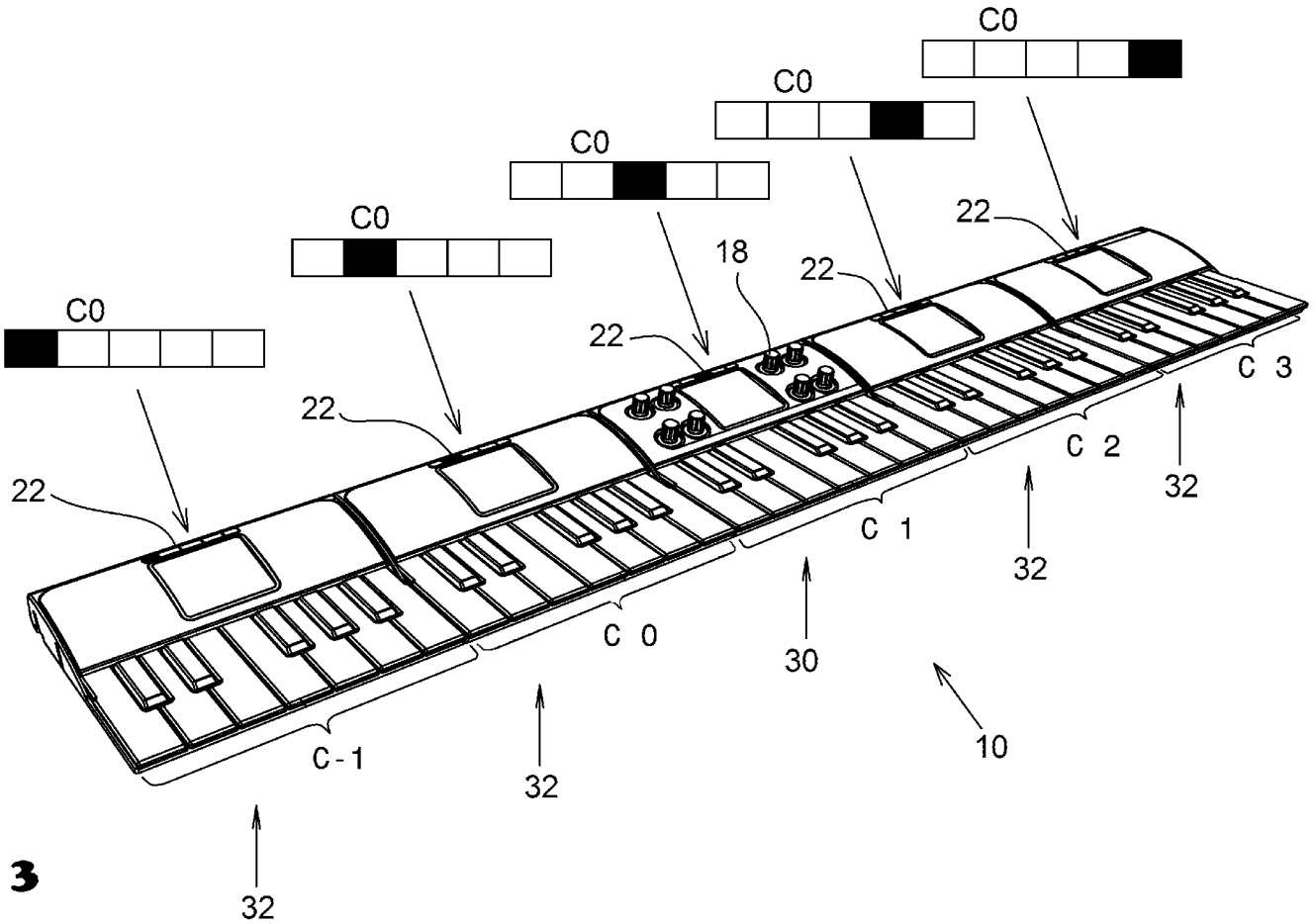
- FIG. 3 schematically illustrates a modular electronic musical keyboard instrument, according to one embodiment of the invention.

FIG. 3 schematically illustrates a modular electronic musical keyboard instrument, according to one embodiment of the invention.

Each of the playing segments comprises an array of buttons 22, for determining the octave level thereof. In this figure, above each of the playing segments is illustrated a scheme of the array of buttons 22.

The location of a button in array 22 determines the order of the segment, and consequently determines its octave level. The user may shift the octaves lower and higher by using control keys 18.

In the illustration, the leftmost button of array 22 of the leftmost keyboard segments is pressed down; the second button of the second segment from the left is also pressed down, and so on. Assuming the C0 octave is assigned to the second segment from the left, octave C-1 should then be assigned to the leftmost keyboard, and so on.

Only one button of array 22 should be pressed in a time point. This can be obtained by a mechanism in which upon pressing one button, the other buttons are released. Of course, the button may be of touch buttons type, and the indication of which button is "pressed" can be carried out by a LED.

Figure 4:
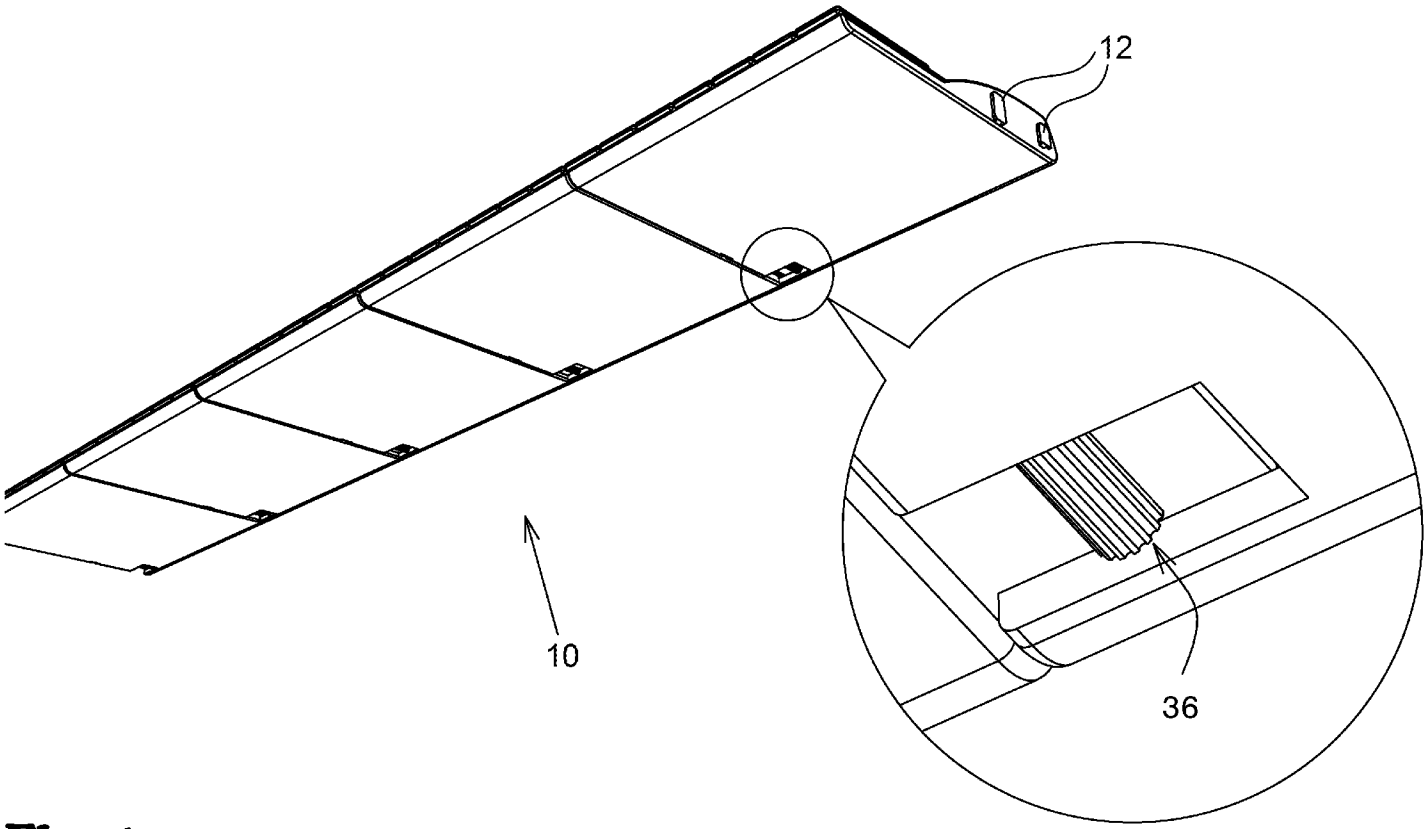
FIG. 4 is a bottom view on a modular electronic musical keyboard instrument, according to one embodiment of the invention.

FIG. 4 is a bottom view on a modular electronic musical keyboard instrument, according to one embodiment of the invention.

From this point of view, a locking mechanism 36 can be seen. The locking mechanism is used for locking an attachment of two subsequent keyboard segments to each other.

Male connectors 12 thereof are also shown in this figure.

Figure 5:
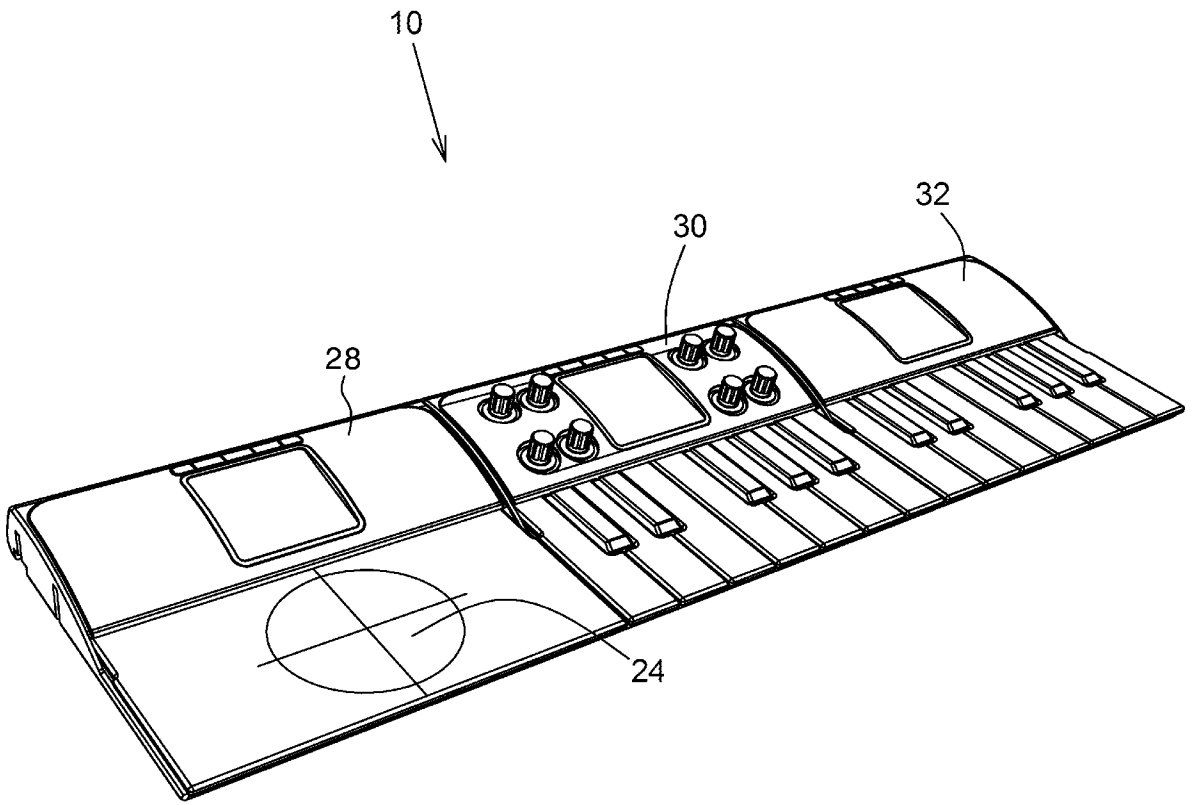
FIG. 5 schematically illustrates a modular electronic musical keyboard instrument, according to one embodiment of the invention.

FIG. 5 schematically illustrates a modular electronic musical keyboard instrument, according to one embodiment of the invention.

The modular electronic musical keyboard instrument 10 comprises a control segment 30, a key segment 32 and a percussion segment 28. The percussion segment 28 employs percussion keys 24 in the form of a sliced circle.

Figure 6:
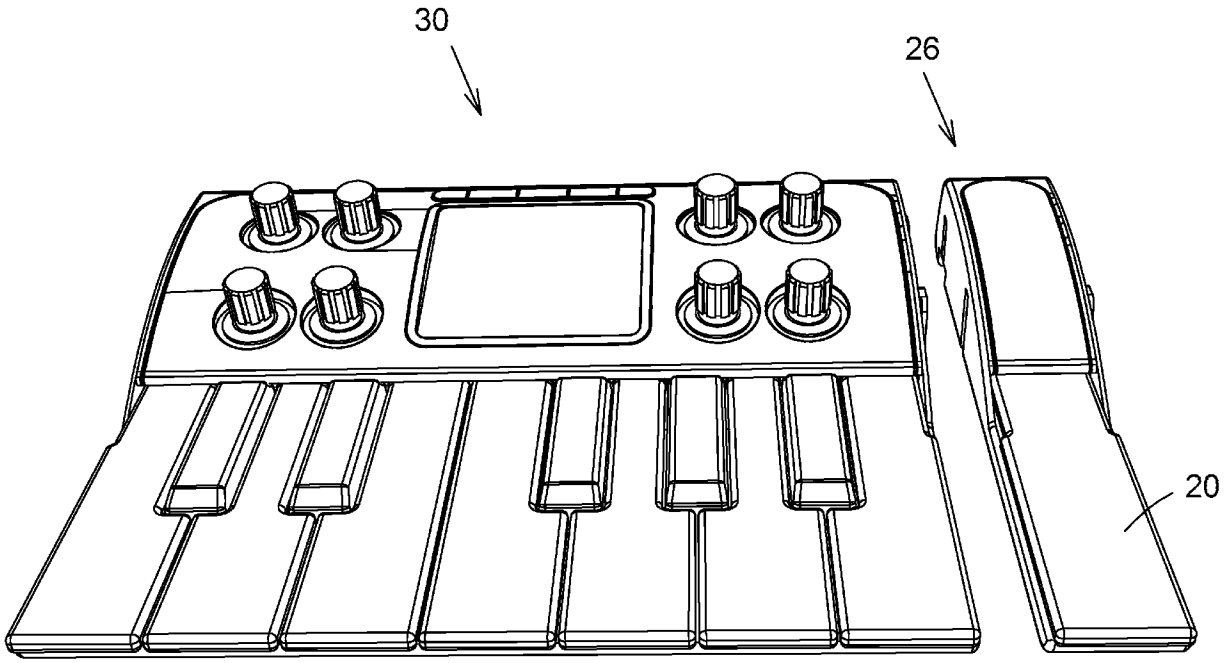
FIG. 6 schematically illustrates a modular electronic musical keyboard instrument, according to one embodiment of the invention.

FIG. 6 schematically illustrates a modular electronic musical keyboard instrument, according to one embodiment of the invention.

According to this embodiment of the invention, the modular electronic musical keyboard instrument comprises a control segment 30, and a single key segment 26.

The single key segment 26 is an example, and actually a segment of a different number of keys, not necessarily 12 keys, can be attached as the leftmost or rightmost segment of the modular electronic musical keyboard instrument.

In the figures and/or description herein, the following reference numerals (Reference Signs List) have been mentioned:

- numeral 10 denotes a modular electronic musical keyboard instrument, according to one embodiment of the invention;
- numeral 12 denotes a male connector;
- numeral 14 denotes a female connector;
- numeral 16 denotes a screen;
- numeral 18 denotes a control knob, as an example to input means for providing a range of inputs;
- numeral 20 denotes key(s) of a modular electronic musical keyboard instrument;
- numeral 22 denotes an array of buttons, for determining the octave level of the segment;
- numeral 24 denotes a percussion key;
- numeral 26 denotes a single key segment;
- numeral 28 denotes a percussion segment;
- numeral 30 denotes a control segment;
- numeral 32 denotes a "regular" segment; and
- numeral 36 denotes a locking mechanism, for locking two subsequent segments to each other.

In the description herein, the following acronyms/terms have been mentioned:

- LED is the acronym of Liquid Crystal Diode;
- Bluetooth is open specification for short-range wireless communication between various types of communication devices;
- USB is the acronym of Universal Serial Bus;
- MIDI is digital interface for musical instruments, standard for information transfer between electronic musical instruments and computers; and
- RF is the acronym of radio frequency.

The following reference is considered to be the closest prior art: U.S. Pat. No. 7,977,561.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A modular electronic musical keyboard instrument, comprising:

an array of separate keyboard segments, each comprising a piano keyboard in a range of at least one octave;

a control system, for converting a keystroke of each key in the array of keyboard segments to a note sound in a level corresponding to the order of the key in the array of keyboard segments;

octave order setting means, for determining to the control system the order of each keyboard segment in the array of keyboard segments;

communication means of each of the keyboard segments with the control system; and connection means with another keyboard segment.

2. A modular electronic musical keyboard instrument according to claim 1, wherein the octave order setting means comprise:

an array of buttons, in which only one button can be set to on in a time point;

wherein the order of each button in the array of buttons corresponds to the order of the segment thereof in the array of keyboard segments.

3. A modular electronic musical keyboard instrument according to claim 1, further comprising a segment of less than one octave, for connecting thereof to an extreme segment of the modular electronic musical keyboard instrument.

4. A modular electronic musical keyboard instrument according to claim 1, wherein the control system is installed in one of the keyboard segments.

5. A modular electronic musical keyboard instrument according to claim 1, wherein the control system comprises means for adjusting the octave level of the segments.

6. A modular electronic musical keyboard instrument according to claim 1, further comprising a percussion segment attachable to each of the keyboard segments.

7. A modular electronic musical keyboard instrument according to claim 1, wherein the communication means is wired.

8. A modular electronic musical keyboard instrument according to claim 1, wherein the communication means is wireless.

9. A modular electronic musical keyboard instrument according to claim 1, wherein the communication means is selected from a member of the group consisting of: USB communication, conductive wires.

10. A modular electronic musical keyboard instrument according to claim 1, wherein the communication means is selected from the group consisting of: Bluetooth communication, RF communication.

11. A modular electronic musical keyboard instrument according to claim 1, wherein the connection means employs a male-female connector.

12. A modular electronic musical keyboard instrument according to claim 1, wherein the connection means employs magnetic means.

13. A modular electronic musical keyboard instrument according to claim 1, wherein the first note of each keyboard segment is a C note.

14. A modular electronic musical keyboard instrument according to claim 1, wherein the first note of each keyboard segment is an A note.

15. A modular electronic musical keyboard instrument according to claim 1, each of the segments comprising a connector, for passing therethrough electric power to a subsequent keyboard segment thereof.

16. A modular electronic musical keyboard instrument according to claim 1, each of the segments comprising a connector, for passing therethrough a signal responsive to a keystroke to a subsequent keyboard segment thereof.

17. A modular electronic musical keyboard instrument according to claim 1, wherein at least one of the segments comprises a touch screen, for being used as input means for setting the operation of the modular electronic musical keyboard instrument.

18. An electronic musical keyboard segment, comprising:

a piano keyboard comprising a plurality of keys in a range of one or two or three octaves only;

level setting means, for determining an octave level of the piano keyboard; and a converter, for converting a keystroke of each key of said piano keyboard to a note sound within the determined octave level.

* * * * *